US011378993B2

(12) United States Patent
Dyer

(10) Patent No.: US 11,378,993 B2
(45) Date of Patent: Jul. 5, 2022

(54) VOLTAGE REGULATOR CIRCUIT WITH CURRENT LIMITER STAGE

(71) Applicant: Microsoft Technology Licensing, LLC, Redmond, WA (US)

(72) Inventor: Kenneth Colin Dyer, Pleasanton, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 17/030,267

(22) Filed: Sep. 23, 2020

(65) Prior Publication Data

US 2022/0091623 A1 Mar. 24, 2022

(51) Int. Cl.

| | |
|---|---|
| ***G05F 1/573*** | (2006.01) |
| ***G05F 1/575*** | (2006.01) |
| ***G05F 1/46*** | (2006.01) |
| ***G05F 1/445*** | (2006.01) |

(52) U.S. Cl.

CPC ..... *G05F 1/575* (2013.01); *G05F 1/445* (2013.01); *G05F 1/461* (2013.01); *G05F 1/468* (2013.01); *G05F 1/5735* (2013.01)

(58) Field of Classification Search

CPC . G05F 1/56; G05F 1/562; G05F 1/563; G05F 1/565; G05F 1/569; G05F 1/573

USPC ..... 323/269–289, 315

See application file for complete search history.

(56) References Cited

U.S. PATENT DOCUMENTS

| | | | |
|---|---|---|---|
| 4,013,925 A | 3/1977 | Tice et al. | |
| 5,666,044 A | 9/1997 | Tuozzolo | |
| 5,764,460 A | 6/1998 | Perillo et al. | |
| 6,346,799 B2 | 2/2002 | Renous | |
| 6,977,491 B1 | 12/2005 | Caldwell et al. | |
| 7,170,352 B1 * | 1/2007 | Caldwell | H03F 3/45475 330/261 |

(Continued)

FOREIGN PATENT DOCUMENTS

WO 2021128199 A1 7/2021

OTHER PUBLICATIONS

"Short Circuit Condition", Retrieved from: https://www.sciencedirect.com/topics/engineering/short-circuit-condition, Retrieved Date: Jul. 27, 2020, 12 Pages.

(Continued)

*Primary Examiner* — Thienvu V Tran
*Assistant Examiner* — Nusrat Quddus
(74) *Attorney, Agent, or Firm* — Alleman Hall Creasman & Tuttle LLP

(57) ABSTRACT

Examples are disclosed herein that relate to automatically limiting an output current of a voltage regulator circuit responsive to detecting that the voltage regulator is in a current overload mode. In one example, a voltage regulator circuit includes an amplifier stage and a current limiter stage electrically connected to an output of the amplifier stage. The amplifier stage is configured to output a DC voltage based on a reference voltage and feedback from an output voltage. The current limiter stage is configured to operate in a quiescent mode and an overload mode. In the quiescent mode, the current limiter stage is configured to operate as a buffer stage that forms a closed feedback loop to an input of the amplifier stage. In the overload mode, the current limiter stage is configured to act as a current source that clamps an output current to a designated current.

20 Claims, 7 Drawing Sheets

(56) References Cited

U.S. PATENT DOCUMENTS 7,710,090 B1 * 5/2010 Kimura ..... G05F 1/5735 323/276
7,923,976 B2 4/2011 Al-Shyoukh et al.
7,974,049 B2 * 7/2011 Kappes ..... H03F 1/523 361/18
8,416,547 B2 * 4/2013 Chiu ..... H03F 1/52 361/87
8,841,897 B2 9/2014 Williams et al.
2006/0113972 A1 * 6/2006 Mihara ..... G05F 1/575 323/273
2007/0216383 A1 * 9/2007 Al-Shyoukh ..... G05F 1/468 323/280
2009/0195953 A1 * 8/2009 Chen ..... G05F 1/573 361/87
2009/0201618 A1 8/2009 Hasegawa et al.
2009/0273323 A1 * 11/2009 Kimura ..... G05F 1/575 323/265
2011/0084682 A1 4/2011 Yu et al.
2012/0262137 A1 * 10/2012 Arigliano ..... G05F 1/573 323/277
2013/0285631 A1 * 10/2013 Bisson ..... G05F 1/575 323/280
2016/0179115 A1 * 6/2016 Kronmueller ..... H03F 3/45183 323/280
2017/0090493 A1 * 3/2017 Cui ..... G05F 1/575
2017/0102724 A1 * 4/2017 Petenyi ..... G05F 1/575
2020/0272184 A1 * 8/2020 Petenyi ..... G05F 1/575
2021/0018944 A1 * 1/2021 Matyscak ..... G05F 1/56

OTHER PUBLICATIONS

"International Search Report and Written Opinion Issued in PCT Application No. PCT/US21/034685", dated Sep. 9, 2021, 15 Pages.

* cited by examiner

VOLTAGE REGULATOR CIRCUIT WITH CURRENT LIMITER STAGE

BACKGROUND

An electronic device may include an integrated circuit having an internal or "on-chip" voltage regulator that is used to provide power to an "off-chip" electrical load while regulating the voltage.

SUMMARY

Examples are disclosed herein that relate to automatically limiting an output current of a voltage regulator circuit responsive to detecting that the voltage regulator is in a current overload mode. In one example, a voltage regulator circuit includes an amplifier stage and a current limiter stage electrically connected to an output of the amplifier stage. The amplifier stage is configured to output a DC voltage based on a reference voltage and feedback from an output voltage. The current limiter stage is configured to operate in a quiescent mode and an overload mode. In the quiescent mode, the current limiter stage is configured to operate as a buffer stage that forms a closed feedback loop to an input of the amplifier stage. In the overload mode, the current limiter stage is configured to act as a current source that clamps an output current to a designated current.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
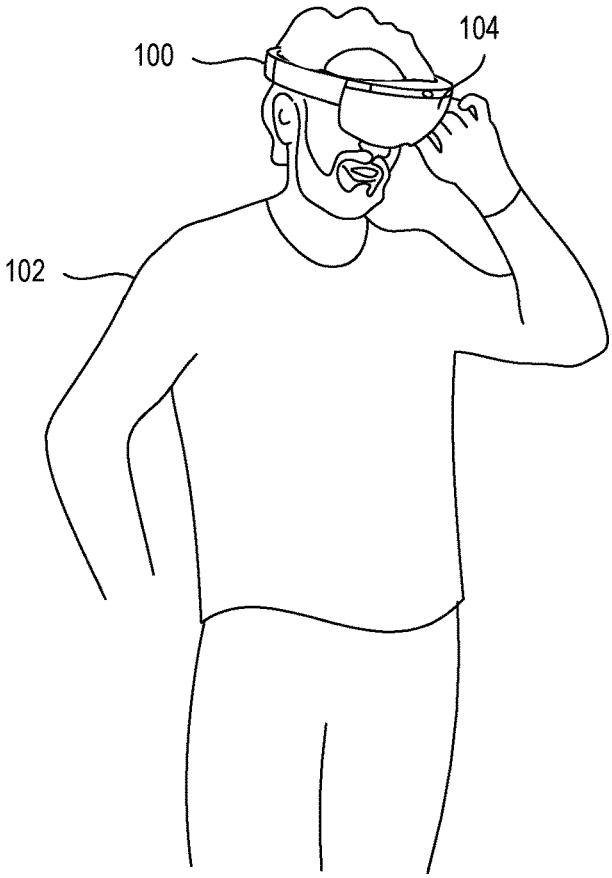
FIG. 1 shows an example head-mounted display device (HMD) that includes an on-chip voltage regulator circuit.

Under certain operating conditions of an electronic device, a significant amount of current may be output from an "on-chip" voltage regulator integral to an integrated circuit to a discrete "off-chip" electronic component. Such high current can cause degradation of the integrated circuit, the electronic component, and/or intermediate electrical connections resulting in a reduced operational lifetime of the electronic device. As one example, an electronic device may include a discrete capacitor that is charged by an on-chip voltage regulator when the electronic device is turned on. Under certain operating conditions, a significant amount of current may be output from the on-chip voltage regulator of the integrated circuit to the discrete off-chip electronic component. Power-cycling of the integrated circuit can cause a significant amount of current to be output from the on-chip voltage regulator of the integrated circuit to the discrete off-chip electronic component. Such high current can cause degradation of the integrated circuit, the off-chip electronic component, and/or the intermediate electrical connections, which may result in a reduced operational lifetime of the electronic device. Additionally, high-current surges can also negatively affect other chips and/or other electrical components in the system via a brown-out event associated with the high current surges.

Accordingly, the present description is directed to a voltage regulator circuit including an amplifier stage and a current limiter stage electrically connected to an output of the amplifier stage. The amplifier stage is configured to output a DC voltage based on a reference voltage and feedback from an output voltage. The current limiter stage is configured to operate in a quiescent mode and an overload mode. In the quiescent mode, the current limiter stage is configured to operate as a buffer stage that forms a closed feedback loop to an input of the amplifier stage. In the overload mode, the current limiter stage is configured to act as a current source that clamps an output current to a designated current. The overload mode may be triggered based on an output current of the voltage regulator circuit being greater than a designated threshold current. As one example, such a condition may occur based on an output node of the voltage regulator circuit being shorted to ground. As another example, such a condition may occur in some instances during power cycling of an electronic device that includes the voltage regulator circuit. When the current overload condition that triggers operation in the overload mode is mitigated, the voltage regulator circuit is configured return to normal operation where the current limiter stage operates in the quiescent mode.

The disclosed example current limiter stages can be implemented on-chip at the transistor level without use of external off-chip electrical components or digital signal processing. Such a configuration allows for the current limiter stage to detect a current overload condition of the voltage regulator circuit more quickly than a configuration that relies on a digital signal processing block of an integrated circuit to detect a current overload condition. Moreover, such a current limiter stage implemented at the transistor level may be configured to switch the voltage regulator circuit back to normal operation in the quiescent operating mode once the current overload condition is cleared quicker than a configuration that uses, for example, a digital signal processing block of the integrated circuit to detect the current overload condition. Furthermore, since the current limiter stage is implemented at the transistor level on chip, the voltage regulator circuit may have a physical footprint that is smaller than a voltage regulator circuit that uses discrete, off-chip electrical components, such as a switcher that employs discrete inductors.

Figure 2:
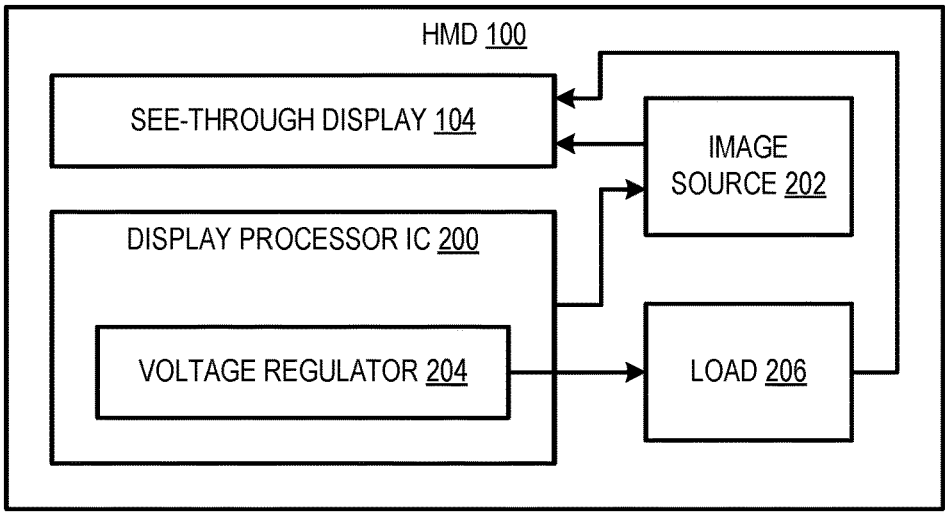
FIG. 2 schematically shows a system block diagram of the HDM shown in FIG. 1.

As an example use environment for a voltage regulator according to the present disclosure, FIG. 1 shows an example head-mounted device (HMD) 100 worn by a user 102. The HMD 100 comprises a see-through display 104 configured to present virtual imagery to provide the user 102 with an augmented reality experience. FIG. 2 schematically shows a system block diagram of the HDM 100 shown in FIG. 1. The HMD 100 comprises a display processor integrated circuit (IC) 200 that is configured to control an image source 202. The image source 202 is configured to visually present virtual imagery on the see-through display 104. In some examples, the display processor integrated circuit 200 may take the form of a system on a chip (SoC). It will be appreciated that that display processor integrated circuit 200 may take any suitable form of integrated circuit also referred to as a "chip." The display processor integrated circuit 200 comprises a voltage regulator circuit 204 configured to regulate a voltage of power provided to a load 206. The load 206 may comprise a discrete, off-chip electronic component. In one example, the electronic component may comprise a capacitor that is used to power the see-through display 104. It will be appreciated that the voltage regulator circuit 204 may be configured to regulate a voltage of any suitable electronic component of the HMD 100. In some implementations, the display processor integrated circuit 200 may include a plurality of voltage regulator circuits to regulate voltages of different discrete electronic components electrically connected to the display processor integrated circuit 200. The display processor integrated circuit 200 may include any suitable number of voltage regulator circuits. The HMD 100 is provided as a non-limiting example of an electronic device that comprises a voltage regulator circuit having current limiting functionality as described herein and the disclosed examples of voltage regulator circuits with such current limiting functionality may be implemented in any suitable type of electronic device.

Figure 3A:
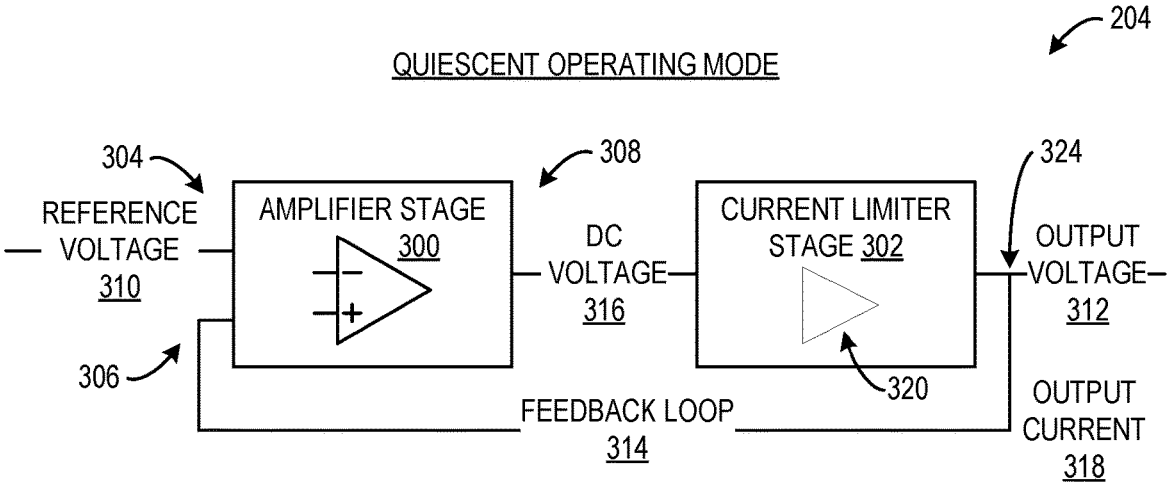
FIG. 3A shows a system block diagram of an example voltage regulator circuit operating in a quiescent mode.
Figure 3B:
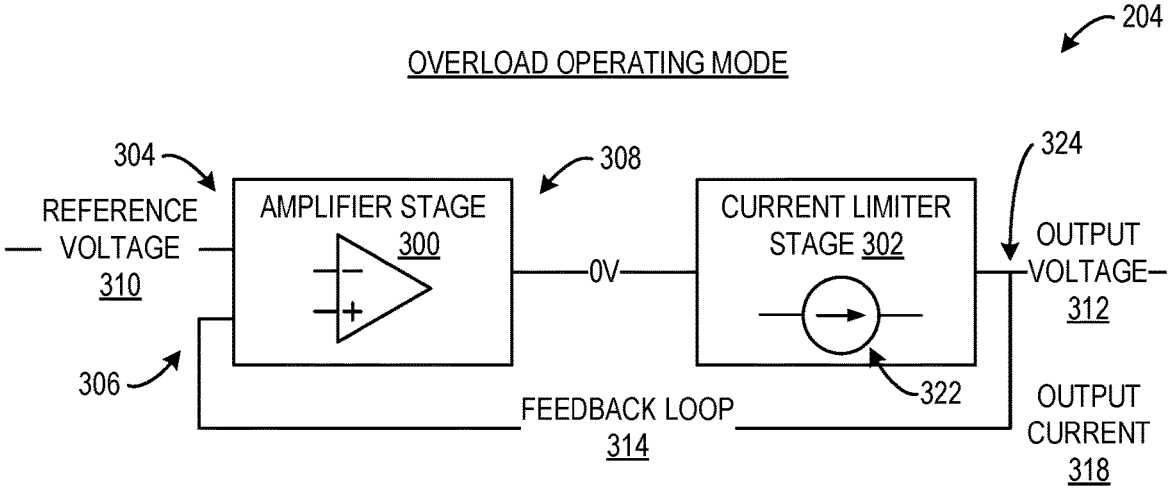
FIG. 3B shows a system block diagram of an example voltage regulator circuit operating in an overload mode.

FIGS. 3A and 3B schematically show a system block diagram of the voltage regulator circuit 204 shown in FIG. 2. The voltage regulator circuit 204 is configured to operate in either one of two discrete operating modes. The first operating mode is a quiescent or steady state operating mode in which the voltage regulator circuit 204 operates during normal operating conditions as shown in FIG. 3A. The second operating mode is an overload operating mode that is triggered based on an output current of the voltage regulator circuit 204 being greater than a threshold current of the voltage regulator circuit 204 as shown in FIG. 3B.

The voltage regulator circuit 204 comprises an amplifier stage 300 and a current limiter stage 302. The amplifier stage 300 comprises a negative input 304, a positive input 306, and an output 308. The negative input 304 is configured to receive a reference voltage 310. In one example, the reference voltage is set to a DC power supply voltage (e.g., VDD) of the voltage regulator circuit 204. It will be appreciated that the reference voltage may be set to any suitable voltage to satisfy the design requirements of the electronic device in which the voltage regulator circuit is implemented. The positive input 306 is configured to receive feedback of an output voltage 312 of the voltage regulator circuit 204 via a feedback loop 314. The amplifier stage 300 is configured to output a DC voltage 316 based on the reference voltage 310 and the feedback from the output voltage 312 of the voltage regulator circuit 204. In the illustrated example, the amplifier stage 300 is configured as a differential amplifier stage that amplifies a difference between the feedback of the output voltage 312 and the reference voltage 310, such that the DC voltage 316 output from the amplifier stage 300 is set to the reference voltage 310. In other implementations, the amplifier stage 300 may be configured as a different type of amplifier stage. The current limiter stage 302 is electrically connected to the output 308 of the amplifier stage 300.

As shown in FIG. 3A, in the quiescent operating mode, the current limiter stage 302 is configured to operate as a buffer stage 320 that forms the closed feedback loop 314 that feeds the output voltage 312 of the voltage regulator circuit 204 back to the positive input 306 of the amplifier stage 300. In the illustrated example, the buffer stage 320 is configured to operate as a unity gain buffer in the quiescent operating mode. In other implementations, the current limiter stage 302 may be configured to operate at a buffer stage that amplifies the DC voltage 316 output from the amplifier stage 300 with a designated gain that is not one and may be inverting in some instances. In implementations where the current limiter stage 302 is inverting, negative feedback may be provided to the input of the amplifier stage 300. Such negative feedback may facilitate stable operation of the voltage regulator circuit 204 in the quiescent operating mode.

The voltage regulator circuit 204 may be configured to switch from the quiescent operating mode to the overload operating mode based on the output current 318 being greater than a threshold current of the voltage regulator circuit 204. The threshold current of the voltage regulator circuit 204 may be set to any suitable threshold current. In some examples, the threshold current may be set based on the operating characteristics of the amplifier stage 300 (e.g., a threshold current of the op-amp). The switch from the quiescent operating mode to the overload operating mode may be triggered based on various operating conditions. As one example, the voltage regulator circuit 204 may switch from operation in the quiescent operating mode to operation in the overload operating mode responsive to a short circuit at an output node 324 of the voltage regulator circuit 204. As another example, the voltage regulator circuit 204 may switch from operation in the quiescent operating mode to operation in the overload operating mode responsive to a non-short circuit, high current condition where the output current 318 is greater than the threshold current. For example, such a condition may occur during power cycling of the electronic device when a capacitor that receives power from the voltage regulator circuit is at least partially discharged.

As shown in FIG. 3B, in the overload operating mode, the amplifier stage 300 clips the DC voltage 316 to zero volts based on the output current 318 fed back to the input 306 of the amplifier stage 300 being greater than the threshold current. When the current limiter stage 302 detects zero volts at the output 308 of the amplifier stage 300, the current limiter stage 302 is configured to switch from operation in the quiescent operating mode to operation in the overload operating mode. In operation in the overload operating mode, the current limiter stage 302 is configured to act as a current source 322 that clamps the output current 318 of the voltage regulator circuit 204 to a designated current. The current limiter stage 302 acting as the current source 322 may set the designated current to any suitable current that protects the voltage regulator circuit 204 from degradation.

Furthermore, the voltage regulator circuit 204 may be configured to switch from the overload operating mode to the quiescent operating mode based on the output current 318 being less than the threshold current of the voltage regulator circuit 204. In other words, when the overload current is removed, the voltage regulator circuit 204 may be configured to automatically return to normal operation in the quiescent stage.

Figure 4A:
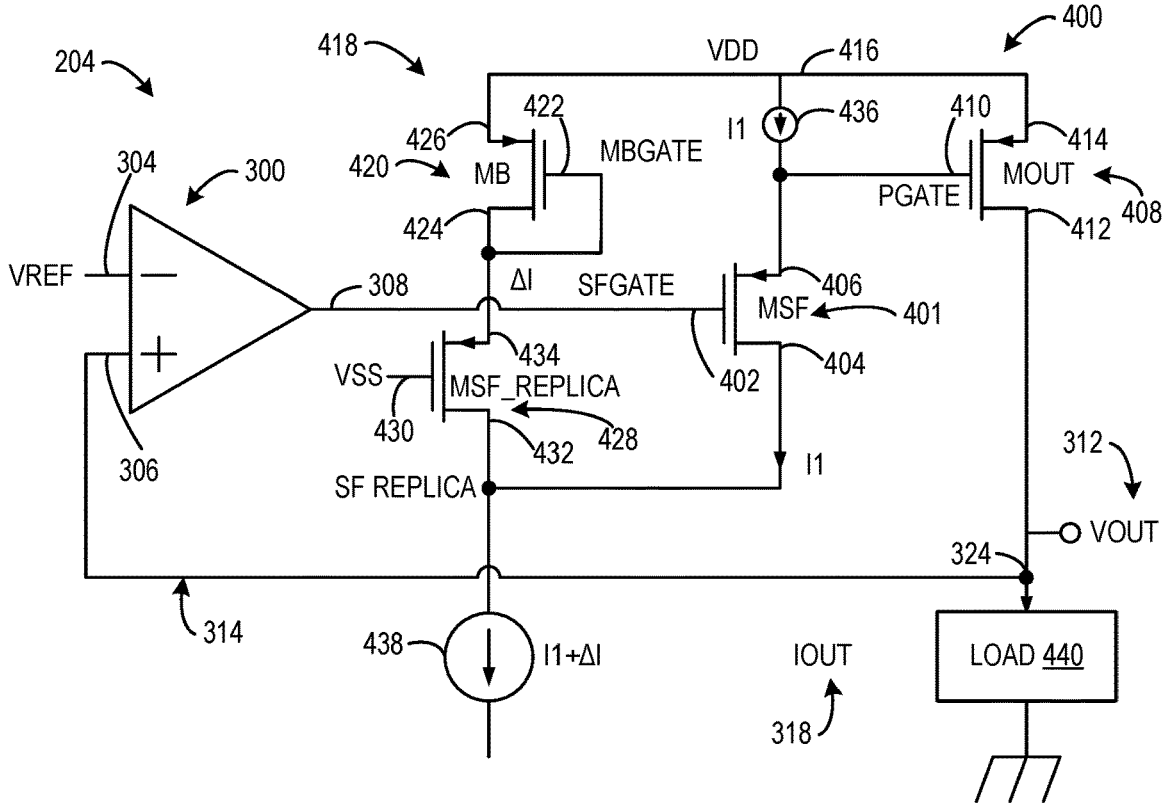
FIG. 4A shows a circuit diagram representing the voltage regulator circuit of FIG. 3A.
Figure 4B:
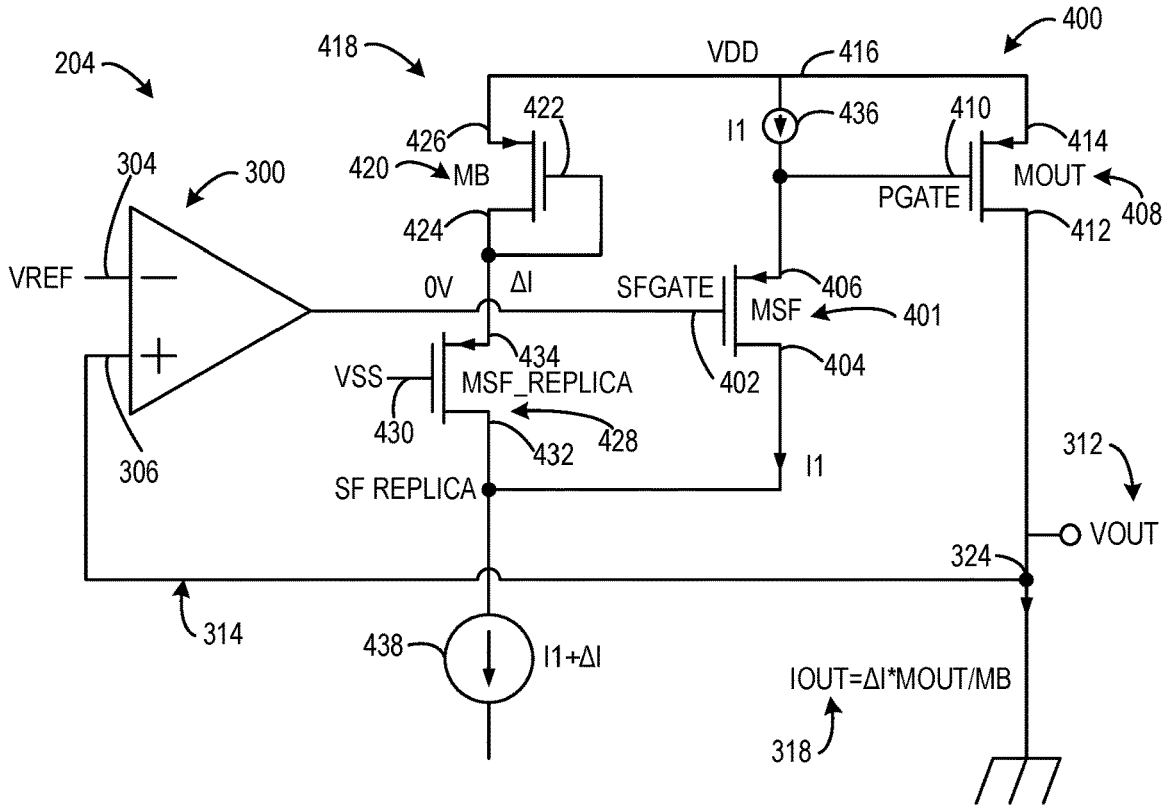
FIG. 4B shows a circuit diagram representing the voltage regulator circuit of FIG. 3B.

FIGS. 4A and 4B show circuit diagrams representing an example implementation of the voltage regulator circuit 204 of FIGS. 3A and 3B, respectively. In particular, FIGS. 4A and 4B show an example current limiter stage 400 suitable for use in the voltage regulator circuit 204 at the transistor level. The current limiter stage 302 comprises a source follower field effect transistor (FET) 401. The source follower FET 401 comprises a gate 402, a drain, 404, and a source 406. The gate 402 of the source follower FET 401 is electrically connected to the output 308 of the amplifier stage 300.

An output FET 408 (MOUT) comprises a gate 410, a drain 412 and a source 414. The gate 410 of the output FET 408 is electrically connected to the source 406 of the source follower FET 401. The source 414 of the output FET 408 is electrically connected to a power supply node 416 (VDD). The power supply node 416 provides DC power to the source terminals of the various FETs in the current limiter stage 302. The DC power may have any suitable voltage that complies with the design characteristics of the voltage regulator circuit 204. The drain 412 of the output FET 408 is electrically connected to the output node 324 of the voltage regulator circuit 204.

A current control stage 418 is electrically intermediate the power supply node 416 and the drain 404 of the source follower FET 401. In the illustrated implementation, the current control stage 418 comprises a current control FET 420 (MB). In other implementations, the current control stage 418 may comprise one or more FETs and/or other electronic components that are configured to control the designated current of the voltage regulator circuitry 204 in the overload operating mode. The current control FET 420 comprises a gate 422, a drain 424, and a source 426. The gate 422 of the current control FET 420 is tied to the drain 424 of the current control FET 420. The source 426 of the current control FET 420 is electrically connected to the power supply node 416.

A source follower replica FET 428 (MSF_REPLICA) comprises a gate 430, a drain 432, and a source 434. The source 434 of the source follower replica FET 428 is electrically connected to the current control stage 418, and specifically to the drain 424 of the current control FET 420. The drain 432 of the source follower replica FET 428 is electrically connected to the drain 404 of the source follower FET 401.

A first current source 436 is electrically connected to the power supply node 416 and electrically intermediate the power supply node 416 and the source 406 of the source follower FET 401 and the gate 410 of the output FET 408. The first current source 436 is configured to output a current (I1). A second current source 438 is electrically connected to the drain 404 of the source follower FET 401 and the drain 432 of the source follower replica FET 428. The second current source 438 is configured to output a current (I1+ΔI).

FIG. 4A shows the current limiter stage 302 operating in the quiescent operating mode. In the quiescent operating mode, the source follower FET 401 and the output FET 408 are configured to operate as the buffer stage 320 (shown in FIG. 3A) that forms the closed negative-feedback loop 314 to feedback the output voltage 318 of the voltage regulator circuit 204 to the input 306 of the amplifier stage 300. The amplifier stage 300 outputs a DC signal having a voltage (referred to as the source follower gate voltage (SFGATE)) that is set based on the reference voltage 310 and the closed negative feedback loop 314. The voltage SFGATE is equal to two transistor threshold voltage levels lower than the power supply voltage (VDD)—i.e., SFGATE equals VDD−2VGS. A gate voltage (PGATE) of the output FET 408 is equal to VDD−VGS. In this way, the source follower FET 401 act as a level shifter that increases the voltage between SFGATE and PGATE in the quiescent operating mode. Additionally, the source follower FET 401 buffers the SFGATE signal to PGATE of the output FET 408 with a gain of 1, such that the source follower FET 401 acts as a unity gain buffer. In the quiescent operating mode, the voltage regulator circuit 204 outputs a DC signal to a load 440 that is connected to the output node 324. The DC signal has the output voltage 318 and the output current 318 (IOUT).

FIG. 4B shows the current limiter stage 302 operating in the overload operating mode. In the overload operating mode, the output of the amplifier stage 300 is set to zero volts. In the illustrated example, the amplifier stage 300 clips to zero volts at the output 308 based on a short circuit at the output node 324. It will be appreciated that other high current condition where the output current 318 is greater than the threshold current of the amplifier stage 300 may cause the amplifier state 300 to output zero volts. In the overload operating mode, when SFGATE goes to zero volts, the source follower FET 401 is configured to act as a triode switch that electrically connects the current control FET 420 of the current control stage 418 to the gate 410 of the output FET 408 such that the output current 318 of the voltage regulator circuit is clamped to the designated current that is controlled by the current control stage 418. In particular, when the source follower FET 401 acts as a triode switch, the current I1 from the first current source 436 flows through the source follower FET 401 to the drain 432 of the source follower replica FET 428. The second current source 438 pulls the current I1+ΔI such that a current ΔI flows through the current control FET 420. The source follower replica FET 401 is configured such that a drain-to-source voltage of the source follower replica FET 428 is equal to a drain-to-source voltage of the source follower FET 401 in the overload operating mode. As such, in the overload operating mode, such a configuration causes a current mirror to be formed between the current control FET 420 and the output FET 408. Such a current mirror causes the output current 318 of the voltage regulator circuit 302 to clamp to the designated current. In particular, the designated current is equal to the current ΔI multiplied by a ratio of the widths of the current control FET 420 and the output FET 408 (i.e., IOUT=ΔI*width_MOUT/width_MB). In an example where the widths of the current control FET 420 and the output FET 408 are the same, the output current 318 is clamped to the current ΔI flowing across the current control FET 420. In another example where the width of the current control FET 420 is much greater than a width of the output FET 408, the output current 318 would be clamped to a significantly lower current than ΔI. The current control stage 418 may include any suitable configuration of electronic components to control the designated current of the voltage regulator circuit 204 in any suitable manner.

The current limiter stage 302 may be configured such that once the overload condition clears by the output current becoming less than the threshold operating current of the amplifier stage 300, the voltage regulator circuit 204 automatically switches back to operation in the quiescent operating mode and the current limiter stages 302 acts as the buffer stage 322 that forms the closed negative feedback loop 314 that feeds the output voltage 312 of the voltage regulator circuit 204 back to the input 306 of the amplifier stage 300.

In the illustrated example, the FETs of the current limiter stage 302 are depicted as a P-type metal oxide silicon field effect transistors (MOSFETs). In other implementations, different type(s) of FETs may be used in the current limiter stage, such as N-type FETs or J-type FETs. In some implementations, another type of transistor may be used in place of one or more of the P-FETs. In some implementations, such transistors may be symmetrical in order to provide the current clamping functionality in the overload operating condition.

Figure 5:
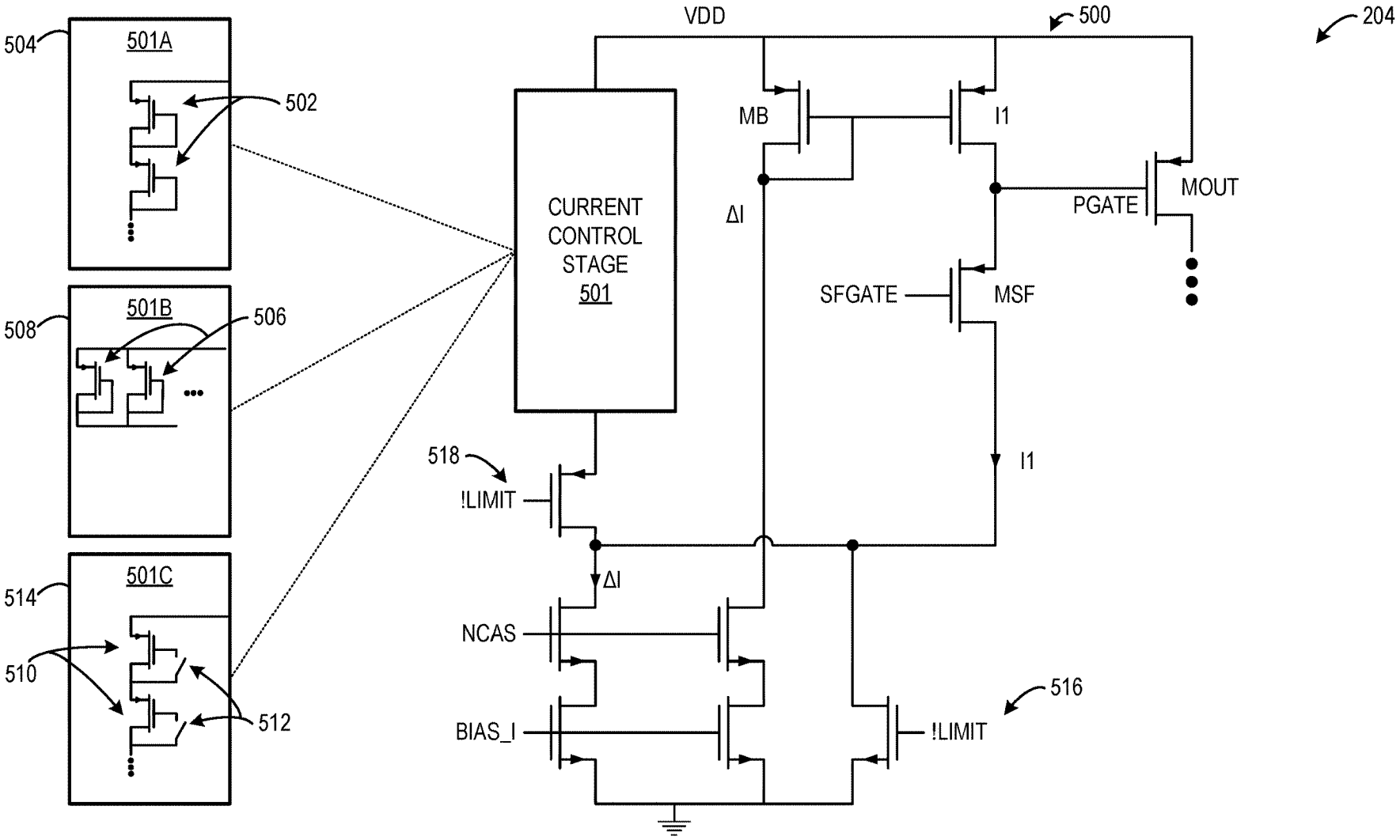
FIG. 5 shows an example current limiter stage of a voltage regulator circuit that includes a current control stage operable to vary a designated current in an overload operating mode.

In the implementation illustrated in FIGS. 4A and 4B, the current control stage 418 comprises a single current control FET 420. In other implementations, the voltage regulator circuit 204 may be configured to have a current control stage that includes other electronic component configurations that are configured to control the designated current differently. FIG. 5 shows an example current limiter stage 500 suitable for use in the voltage regulator circuit 204 The current limiter stage 500 includes a current control stage 501. The current control stage 501 may include any suitable electronic component configuration to set the designated current output by the voltage regulator circuit 204 in the overload operating mode. In some implementations, the current control stage 501 may comprise one or more current control FETS. In some implementations, the current control stage 501A may comprise a plurality of current control FETS 502 in series as shown in box 504. For example, four FETs may be electrically connected in series to provide a 4×1 width ratio of the current control FETs relative to the output FET in the output current equation (e.g., IOUT=ΔI*width_MOUT/width_MB*4). In some implementations, the current control stage 501B may comprise a plurality of current control FETS 506 electrically connected in parallel as shown in box 508. Further, in some implementations, the current control stage 501C may comprise a plurality of current control FETS 510 connected via a plurality of switches 512 operable to vary the designated current as shown in box 514. The switches 512 may allow for different FETs to be selectively turned on to dynamically set the designated current to a desired current. For example, in some instances, a first switch may be turned on and a second switch may be turned off to set a first designated current based on a single transistor. In other instances, the first switch and the second switch may be turned on to set a second designated current based on two transistors connected in series. Such a configuration may include any suitable number of FETs and any suitable number of switches arranged in any suitable manner to achieve any suitable granularity of programmability of the designated current. In still other implementations, another type of electronic component may be used to control the designated current. For example, in some implementations, a digital to analog converter may be used to control the designated current during the overload operating mode. Any suitable electronic component or configuration of multiple electronic components may be used to control the designated current to any suitable desired current during the overload operating mode.

In the illustrated implementation, the voltage regulator circuit 204 includes a first disable FET 516 and a second disable FET 518. The first and second disable FETs 516, 518 may be turned on/off to selectively disable/enable the functionality of the current limiter stage 302 of the voltage regulator circuit 204. In other implementations, such disable/enable functionality of the current limiter stage 302 may be selectively omitted.

Figure 6:
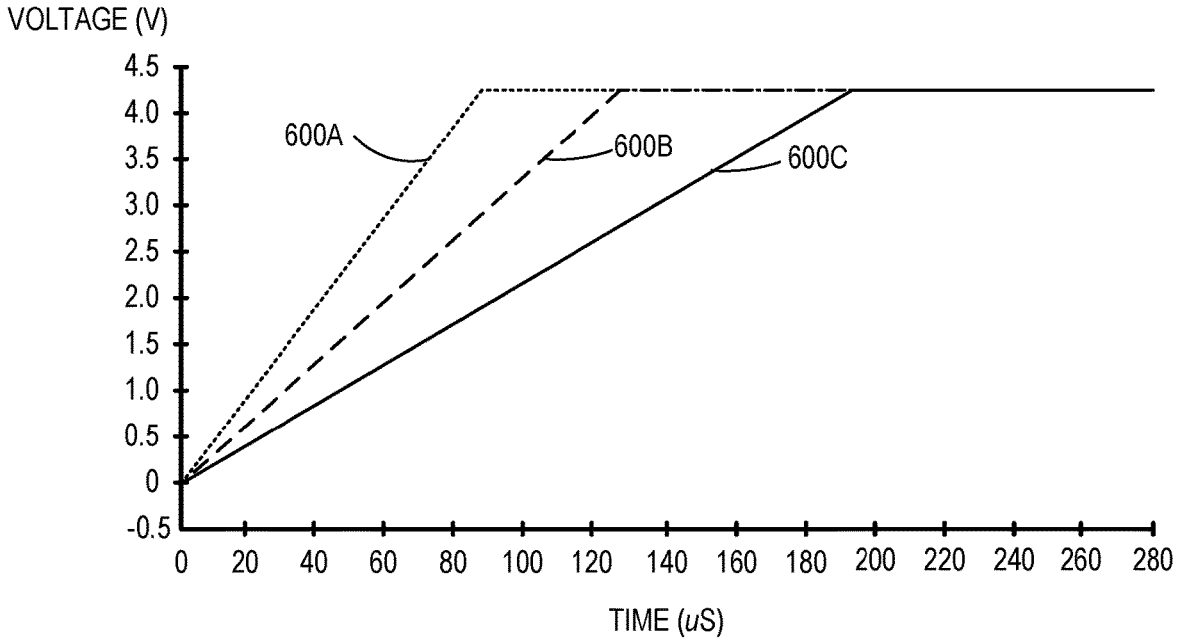
FIG. 6 is a graph showing an output voltage of an example voltage regulator circuit without inrush current limiting functionality and reliability operating in a quiescent mode.
Figure 7:
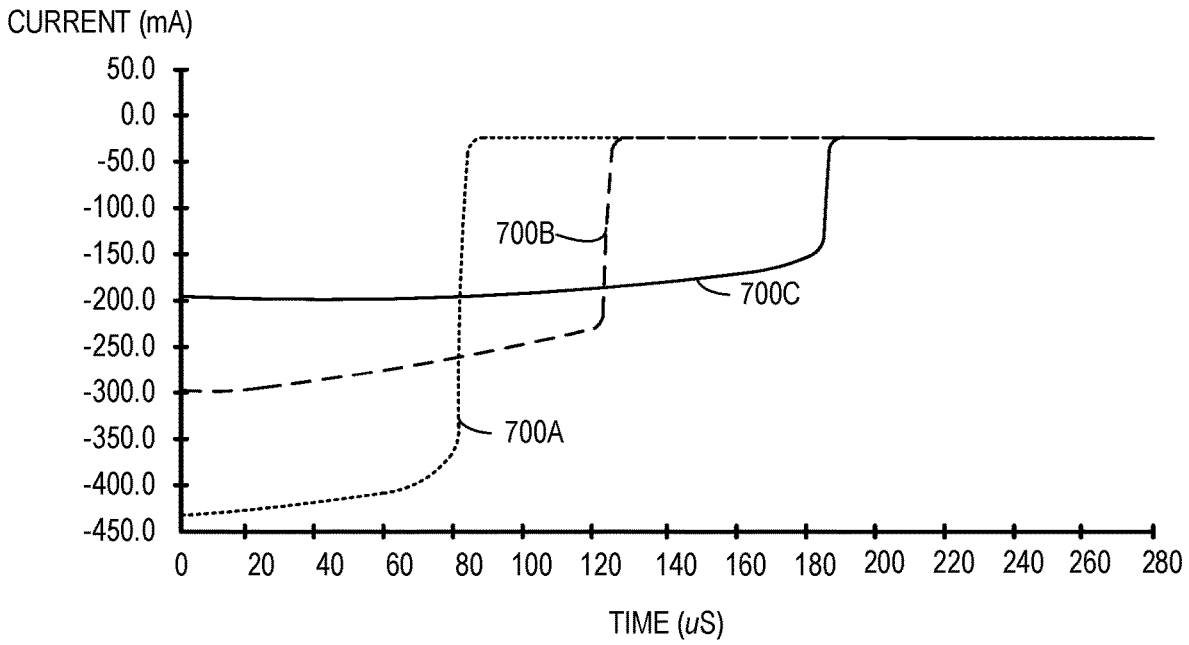
FIG. 7 is a graph showing an output current of the voltage regulator circuit operating without inrush current limiting functionality and reliability in a quiescent mode.

FIGS. 6-7 show graphs illustrating example operation of a voltage regulator circuit without the inrush current limiting functionality and reliability describe herein. FIG. 6 shows example voltage responses 600 (e.g., 600A, 600B, 600C) of a voltage regulator circuit without the inrush current limiting functionality. The different voltage responses 600A, 600B, and 600C are representative of operation of the voltage regulator circuit under different simulated operating conditions (e.g., different temperature, loads). FIG. 7 shows example current responses 700 (e.g., 700A, 700B, 700C) of the voltage regulator circuit without the inrush current limiting functionality. The different current response 700A, 700B, and 700C are representative of operation of the voltage regulator circuit under different simulated operating conditions (e.g., different temperature, loads). In particular, the different current responses 700A, 700B, and 700C illustrate the relatively high variability of operation of the voltage regulator circuit with different currents being output and different switching times occurring based on the different operating conditions. Under some such conditions, the output current of the voltage regulator circuit may be high enough to potentially cause degradation of the voltage regulator circuit.

Figure 8:
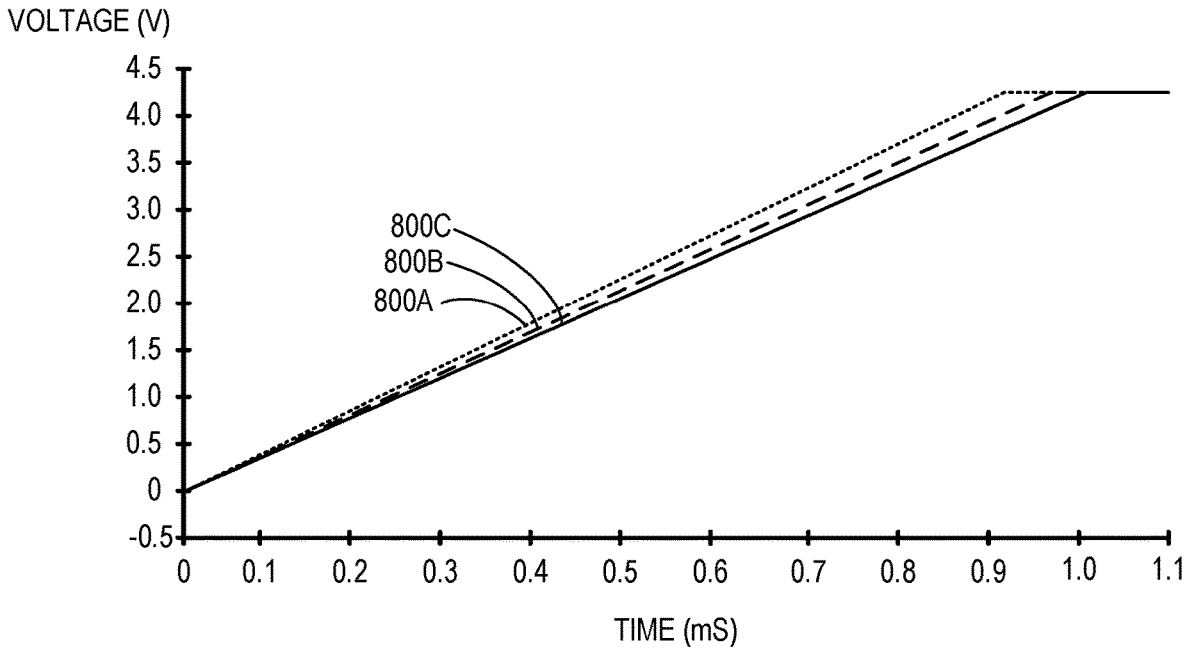
FIG. 8 is a graph showing an output voltage of an example voltage regulator circuit with inrush current limiting functionality and reliability operating in an overload mode.
Figure 9:
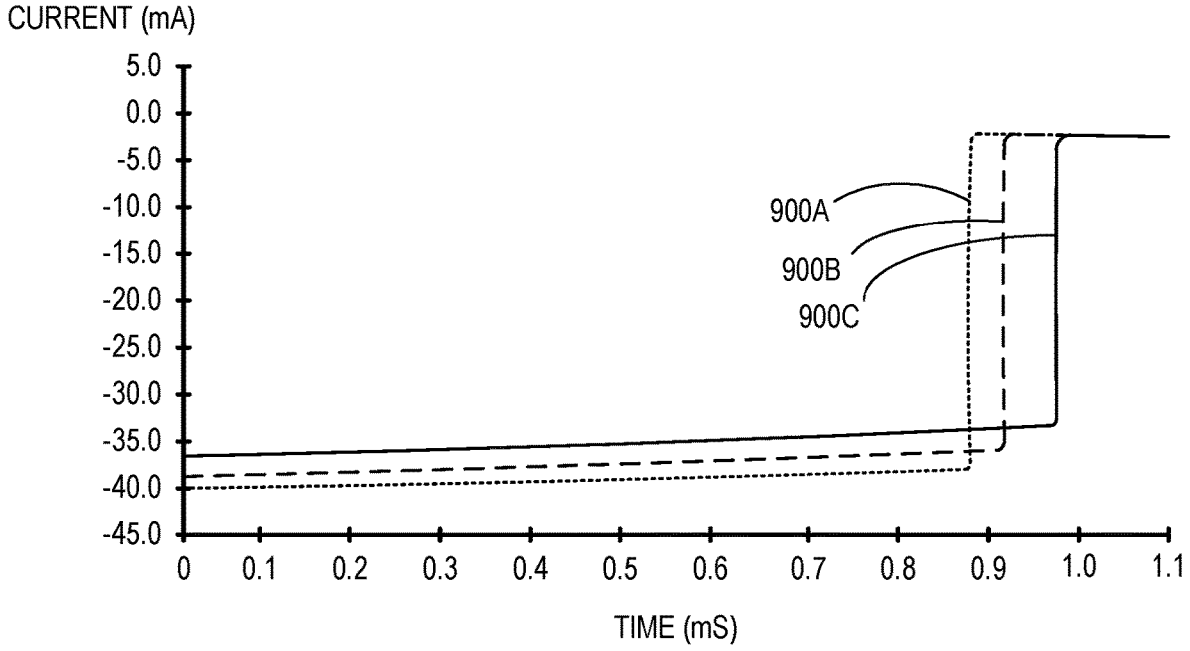
FIG. 9 is a graph showing an output current of an example voltage regulator circuit with inrush current limiting functionality and reliability operating in an overload mode.

FIGS. 8-9 show graphs illustrating example operation of a voltage regulator circuit with the inrush current limiting functionality describe herein. FIG. 8 shows example voltage responses 800 (e.g., 800A, 800B, 800C) of a voltage regulator circuit with the inrush current limiting functionality. The different voltage responses 800A, 800B, and 800C are representative of operation of the voltage regulator circuit under different simulated operating conditions (e.g., different temperature, loads) that correspond to the same operating conditions as the voltage responses 600A, 600B, and 600C shown in FIG. 6. The example voltage responses 800A, 800B, and 800C illustrate the automatic and seamless transition from an overload operating mode to a quiescent operating mode, in addition to providing a potential increased controlled response that is more reliable relative to the voltage responses 600A, 600B, and 600C of the voltage regulator circuit without inrush current limiting functionality. FIG. 9 shows example current responses 900 (e.g., 900A, 900B, 900C) of a voltage regulator circuit with the inrush current limiting functionality. The different current responses 900A, 900B, and 900C are representative of operation of the voltage regulator circuit under different simulated operating conditions (e.g., different temperature, loads) that correspond to the same operating conditions as the current responses 700A, 700B, and 700C shown in FIG. 7. The current responses 900A, 900B, and 900C are potentially slower and more controlled than the current responses 700A, 700B, and 700C shown in FIG. 7, but the more controlled current responses 900A, 900B, and 900C exhibit a possible ten times reduction in current value over the current responses 700A, 700B, and 700C shown in FIG. 7. The more controlled current responses 900A, 900B, and 900C are a result of the inrush current limiting functionality of the voltage regulator circuit that automatically limits the output current of the voltage regulator circuit to the designated current in the overload operating condition. The reduced output current prevents high current from flowing through the voltage regulator circuit and circuits electronically connected to the voltage regulator circuit and thus prevents potential degradation of these electronic circuits.

Figure 10:
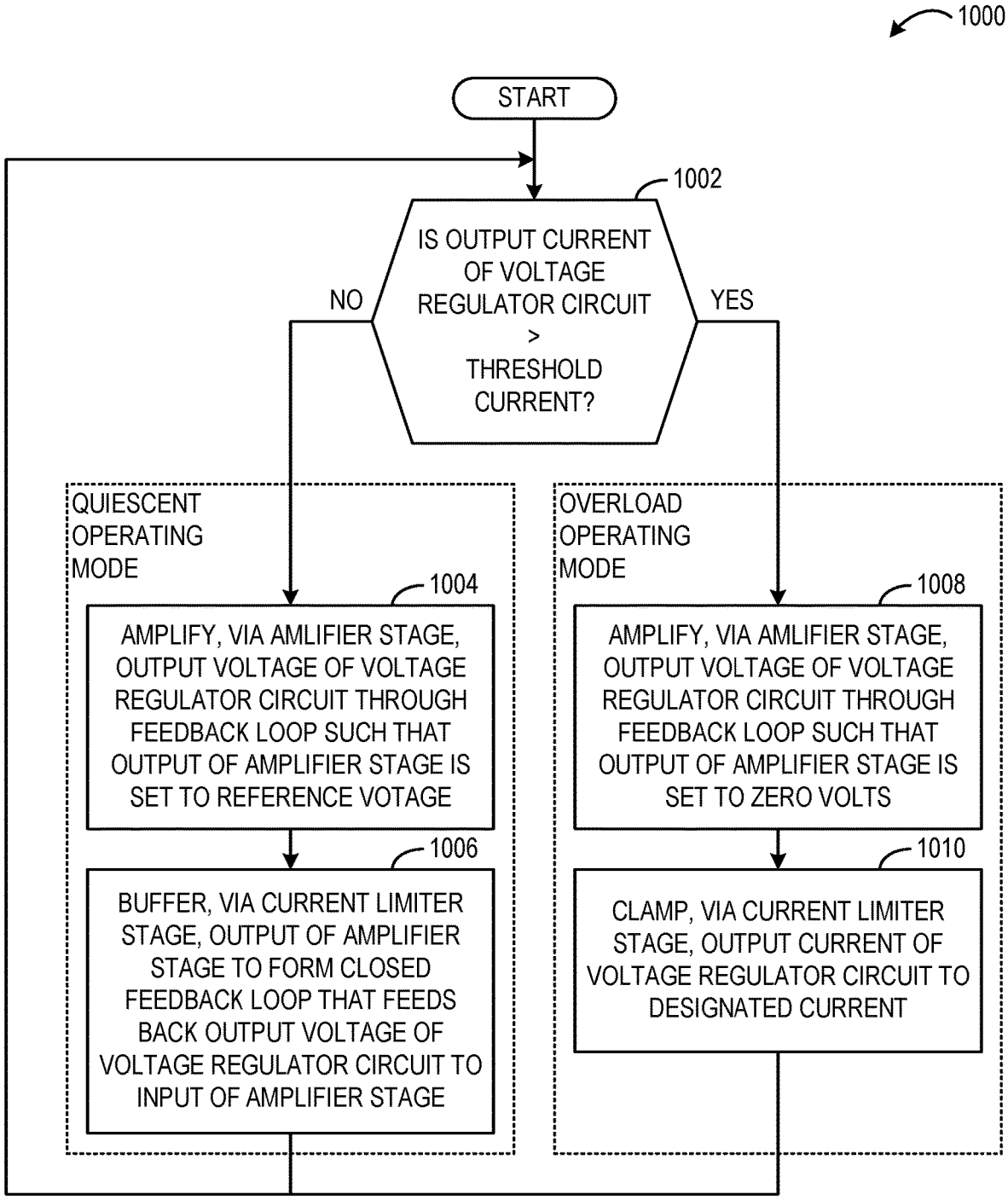
FIG. 10 shows an example method for limiting current of a voltage regulator circuit.

FIG. 10 shows an example method 1000 of operating a voltage regulator circuit with an inrush current limiter. For example, the method 1000 may be performed by any of the voltage regulator circuits shown in FIGS. 2-5 and described herein. At 1002, an amplifier stage of the voltage regulator circuit responds to whether an output current of the voltage regulator circuit is greater than a threshold current. If the output current, is greater than the threshold current, then the voltage regulator circuit operates in an overload operating mode and the method 1000 moves to 1008. Otherwise, the voltage regulator circuit operates in a quiescent operating mode and the method 1000 moves to 1004. At 1004, in the quiescent operating mode, the amplifier stage amplifies an output voltage of the voltage regulator circuit through a feedback loop, such that an output of the amplifier stage is set to a reference voltage. At 1006, in the quiescent operating mode, a current limiter stage buffers the output of the amplifier stage to form the closed feedback loop that feeds back the output voltage of the voltage regulator circuit to the input of the amplifier stage and the method 1000 returns to 1002 to repeat the method 1000. In some implementations, the current limiter stage may be inverting, such that negative feedback is provided to the input of the amplifier stage. At 1008, in the overload operating mode, the amplifier stage amplifies an output voltage of the voltage regulator circuit, such that the output of the amplifier stage is set to zero volts. At 1010, in the overload operating mode, the current limiter stage clamps the output current of the voltage regulator circuit to a designated current and returns to 1002 to repeat the method 1000.

The method 1000 may be performed to automatically respond to a normal current condition of the voltage regulator circuit and operate in a quiescent operating mode to generate an output voltage based on a reference voltage and closed loop feedback of the output voltage of the voltage regulator circuit. Further, the method 1000 may be performed to automatically respond to a current overload condition of the voltage regulator circuit and quickly clamp the output current of the voltage regulator circuit to a designated current. Once the overload condition clears, the method 1000 may be performed to automatically switch back to normal operation in the quiescent operating mode. By performing such a method, brown out events related to high current surge conditions may be mitigated, and more generally operation of such a voltage regulator circuit may be more reliable relative to a voltage regulator circuit that lacks such automatic in rush current limiting functionality.

In an example, a voltage regulator circuit, comprises an amplifier stage configured to output a DC voltage based on a reference voltage and feedback from an output voltage of the voltage regulator circuit, and a current limiter stage electrically connected to an output of the amplifier stage, wherein the current limiter stage is configured to operate in a quiescent operating mode and an overload operating mode, such that in the quiescent operating mode, the current limiter stage is configured to operate as a buffer stage that forms a closed feedback loop that feeds back the output voltage of the voltage regulator circuit to an input of the amplifier stage, and in the overload operating mode, the current limiter stage is configured to act as a current source that clamps an output current of the voltage regulator circuit to a designated current. In this example and/or other examples, the current limiter stage optionally may include a source follower field effect transistor (FET), wherein a gate of the source follower FET may be electrically connected to the output of the amplifier stage, an output FET, wherein a gate of the output FET may be electrically connected to a source of the source follower FET, wherein a source of the output FET may be electrically connected to a power supply node, and wherein a drain of the output FET may be electrically connected to an output node of the voltage regulator circuit, and a current control stage electrically intermediate the power supply node and a drain of the source follower FET, wherein the current limiter stage may be configured to operate in the quiescent operating mode and the overload operating mode, such that in the quiescent operating mode, the source follower FET and the output FET may be configured to operate as the buffer stage that forms the closed feedback loop to feedback the output voltage of the voltage regulator circuit to the input of the amplifier stage, and in the overload operating mode, the source follower FET may be configured to act as a triode switch that electrically connects the current control stage to the gate of the output FET such that the output current of the voltage regulator circuit may be clamped to the designated current that may be controlled by the current control stage. In this example and/or other examples, the current limiter stage optionally may further include a source follower replica FET, wherein a source of the source follower replica FET may be electrically connected to the current control stage, wherein a drain of the source follower replica FET may be electrically connected to the drain of the source follower FET, and wherein the source follower replica FET may be configured such that a drain-to-source voltage of the source follower replica FET is equal to a drain-to-source voltage of the source follower FET in the overload operating mode. In this example and/or other examples, the current limiter stage optionally may further include a first current source electrically connected to the power supply node and electrically intermediate the power supply node and the source of the source follower FET and the gate of the output FET. In this example and/or other examples, the current limiter stage optionally may further include a second current source electrically connected to the drain of the source follower FET. In this example and/or other examples, the current control stage optionally may comprise one or more current control FETS. In this example and/or other examples, the current control stage optionally may comprise a plurality of current control FETS in series. In this example and/or other examples, the current control stage optionally may comprise a plurality of current control FETS connected via a plurality of switches operable to vary the designated current. In this example and/or other examples, the buffer stage optionally may comprise a unity gain buffer stage. In this example and/or other examples, the current limiter stage optionally may be configured to switch from operation in the quiescent operating mode to operation in the overload operating mode responsive to a short circuit at the output node. In this example and/or other examples, the current limiter stage optionally may be configured to switch from operation in the quiescent operating mode to operation in the overload operating mode responsive to the amplifier stage outputting zero volts. In this example and/or other examples, the current limiter stage optionally may be configured to switch from operation in the quiescent operating mode to operation in the overload operating mode responsive to the output current of the voltage regulator circuit being greater than a threshold current.

In another example, a voltage regulator circuit, comprises an amplifier stage configured to output a DC voltage based on a reference voltage and feedback of an output voltage of the voltage regulator circuit, and a current limiter stage including a source follower field effect transistor (FET), wherein a gate of the source follower FET is electrically connected to an output of the amplifier stage, an output FET, wherein a gate of the output FET is electrically connected to the source of the source follower FET, wherein the source of the output FET is electrically connected to a power supply node, and wherein the drain of the output FET is electrically connected to an output node, and a current control stage electrically intermediate the power supply node and the drain of the source follower FET, wherein the current limiter stage is configured to operate in a quiescent operating mode and an overload operating mode, such that in the quiescent operating mode, the source follower FET and the output FET are configured to operate as a buffer stage that forms a closed feedback loop to feedback the output voltage of the voltage regulator circuit to an input of the amplifier stage, and in the overload operating mode, the source follower FET is configured to act as a triode switch that electrically connects the current control stage to the gate of the output FET such that an output current of the voltage regulator circuit is clamped to a designated current controlled by the current control stage. In this example and/or other examples, the current limiter stage optionally may further include a source follower replica FET, wherein a source of the source follower replica FET may be electrically connected to the current control stage, wherein a drain of the source follower replica FET may be electrically connected to the drain of the source follower FET, and wherein the source follower replica FET may be configured such that a drain-to-source voltage of the source follower replica FET is equal to a drain-to-source voltage of the source follower FET in the overload operating mode. In this example and/or other examples, the current limiter stage optionally may further include a first current source electrically connected to the power supply node and electrically intermediate the power supply node and the source of the source follower FET and the gate of the output FET. In this example and/or other examples, the current limiter stage optionally may further include a second current source electrically connected to the drain of the source follower FET. In this example and/or other examples, the current control stage optionally may comprise one or more current control FETS. In this example and/or other examples, the current control stage optionally may comprise a plurality of current control FETS in series. In this example and/or other examples, the current control stage optionally may comprise a plurality of current control FETS connected via a plurality of switches operable to vary the designated current.

In yet another example, a method for limiting current in a voltage regulator circuit comprising an amplifier stage and a current limiter stage, the method comprises amplifying, via the amplifier stage, an output voltage of the voltage regulator circuit through a feedback loop, such that an output of the amplifier stage is set to a reference voltage based on an output current of the voltage regulator circuit being less than a threshold current, and such that the output of the amplifier stage is set to zero volts based on the output current of the voltage regulator circuit being greater than the threshold current, buffering, via the current limiter stage, the output of the amplifier stage based on the output of the amplifier stage being set to the reference voltage, and clamping, via the current limiter stage, the output current of the voltage regulator circuit to a designated current based on the output of the amplifier stage being zero volts.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A voltage regulator circuit, comprising:

an amplifier stage configured to output a DC voltage based on a reference voltage and feedback from an output voltage of the voltage regulator circuit; and a current limiter stage electrically connected to an output of the amplifier stage, the current limiter stage comprising a source follower transistor, wherein the current limiter stage is configured to operate in a quiescent operating mode and an overload operating mode, such that in the quiescent operating mode, the source follower transistor is configured to operate as a buffer stage of the current limiter stage and forms a closed feedback loop that feeds back the output voltage of the voltage regulator circuit to an input of the amplifier stage, and in the overload operating mode, the source follower transistor is configured to operate as a triode switch such that the current limiter stage acts as a current mirror that clamps an output current of the voltage regulator circuit to a designated current.

2. The voltage regulator circuit of claim 1, wherein the source follower transistor comprises a source follower field effect transistor (FET) comprising a gate electrically connected to the output of the amplifier stage, and wherein the current limiter stage includes:

an output FET, wherein a gate of the output FET is electrically connected to a source of the source follower FET, wherein a source of the output FET is electrically connected to a power supply node, and wherein a drain of the output FET is electrically connected to an output node of the voltage regulator circuit, and a current control stage electrically intermediate the power supply node and a drain of the source follower FET;

wherein the current limiter stage is configured to operate in the quiescent operating mode and the overload operating mode, such that in the quiescent operating mode, the source follower FET and the output FET are configured to operate as the buffer stage that forms the closed feedback loop to feedback the output voltage of the voltage regulator circuit to the input of the amplifier stage, and in the overload operating mode, the source follower FET is configured to act as the triode switch that electrically connects the current control stage to the gate of the output FET such that the output current of the voltage regulator circuit is clamped to the designated current that is controlled by the current control stage.

3. The voltage regulator circuit of claim 2, wherein the current limiter stage further includes:

a source follower replica FET, wherein a source of the source follower replica FET is electrically connected to the current control stage, wherein a drain of the source follower replica FET is electrically connected to the drain of the source follower FET, and wherein the source follower replica FET is configured such that a drain-to-source voltage of the source follower replica FET is equal to a drain-to-source voltage of the source follower FET in the overload operating mode.

4. The voltage regulator circuit of claim 2, wherein the current limiter stage further includes:

a first current source electrically connected to the power supply node and electrically intermediate the power supply node and the source of the source follower FET and the gate of the output FET.

5. The voltage regulator circuit of claim 2, wherein the current limiter stage further includes:

a second current source electrically connected to the drain of the source follower FET.

6. The voltage regulator circuit of claim 2, wherein the current control stage comprises one or more current control FETS.

7. The voltage regulator circuit of claim 6, wherein the current control stage comprises a plurality of current control FETS in series.

8. The voltage regulator circuit of claim 6, wherein the current control stage comprises a plurality of current control FETS connected via a plurality of switches operable to vary the designated current.

9. The voltage regulator circuit of claim 1, wherein the buffer stage comprises a unity gain buffer stage.

10. The voltage regulator circuit of claim 1, wherein the current limiter stage is configured to switch from operation in the quiescent operating mode to operation in the overload operating mode responsive to a short circuit at the output node.

11. The voltage regulator circuit of claim 1, wherein the current limiter stage is configured to switch from operation in the quiescent operating mode to operation in the overload operating mode responsive to the amplifier stage outputting zero volts.

12. The voltage regulator circuit of claim 1, wherein the current limiter stage is configured to switch from operation in the quiescent operating mode to operation in the overload operating mode responsive to the output current of the voltage regulator circuit being greater than a threshold current.

13. A voltage regulator circuit, comprising:

an amplifier stage configured to output a DC voltage based on a reference voltage and feedback of an output voltage of the voltage regulator circuit; and a current limiter stage including:

a source follower field effect transistor (FET), wherein a gate of the source follower FET is electrically connected to an output of the amplifier stage, an output FET, wherein a gate of the output FET is electrically connected to the source of the source follower FET, wherein the source of the output FET is electrically connected to a power supply node, and wherein the drain of the output FET is electrically connected to an output node, and a current control stage electrically intermediate the power supply node and the drain of the source follower FET;

wherein the current limiter stage is configured to operate in a quiescent operating mode and an overload operating mode, such that in the quiescent operating mode, the source follower FET and the output FET are configured to operate as a buffer stage that forms a closed feedback loop to feedback the output voltage of the voltage regulator circuit to an input of the amplifier stage, and in the overload operating mode, the source follower FET is configured to act as a triode switch that electrically connects the current control stage to the gate of the output FET such that a current mirror forms between the current control stage and the output FET so that an output current of the voltage regulator circuit is clamped to a designated current controlled by the current control stage.

14. The voltage regulator circuit of claim 13, wherein the current limiter stage further includes:

a source follower replica FET, wherein a source of the source follower replica FET is electrically connected to the current control stage, wherein a drain of the source follower replica FET is electrically connected to the drain of the source follower FET, and wherein the source follower replica FET is configured such that a drain-to-source voltage of the source follower replica FET is equal to a drain-to-source voltage of the source follower FET in the overload operating mode.

15. The voltage regulator circuit of claim 13, wherein the current limiter stage further includes:

a first current source electrically connected to the power supply node and electrically intermediate the power supply node and the source of the source follower FET and the gate of the output FET.

16. The voltage regulator circuit of claim 13, wherein the current limiter stage further includes:

a second current source electrically connected to the drain of the source follower FET.

17. The voltage regulator circuit of claim 13, wherein the current control stage comprises one or more current control FETS.

18. The voltage regulator circuit of claim 17, wherein the current control stage comprises a plurality of current control FETS in series.

19. The voltage regulator circuit of claim 17, wherein the current control stage comprises a plurality of current control FETS connected via a plurality of switches operable to vary the designated current.

20. A method for limiting current in a voltage regulator circuit comprising an amplifier stage and a current limiter stage, the current limiter stage being configured to act as a buffer in a quiescent operating mode and as a current mirror in an overload operating mode, the method comprising:

amplifying, via the amplifier stage, an output voltage of the voltage regulator circuit through a feedback loop, such that an output of the amplifier stage is set to a reference voltage based on an output current of the voltage regulator circuit being less than a threshold current in the quiescent operating mode, and such that the output of the amplifier stage is set to zero volts based on the output current of the voltage regulator circuit being greater than the threshold current in the overload operating mode;

buffering, via the current limiter stage, the output of the amplifier stage based on the output of the amplifier stage being set to the reference voltage in the quiescent operating mode when the current limiter stage is operating as the buffer; and clamping, via the current limiter stage when the current limiter stage is acting as the current mirror in the overload operating mode, the output current of the voltage regulator circuit to a designated current.

* * * * *